US011046074B2

(12) United States Patent
Takabe

(10) Patent No.: US 11,046,074 B2
(45) Date of Patent: Jun. 29, 2021

(54) LIQUID DISCHARGE HEAD, LIQUID DISCHARGE APPARATUS, METHOD OF CONTROLLING THE LIQUID DISCHARGE HEAD, AND A METHOD OF CONTROLLING THE LIQUID DISCHARGE APPARATUS

(71) Applicant: SEIKO EPSON CORPORATION, Tokyo (JP)

(72) Inventor: Motoki Takabe, Shiojiri (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 16/773,688

(22) Filed: Jan. 27, 2020

(65) Prior Publication Data

US 2020/0238701 A1 Jul. 30, 2020

(30) Foreign Application Priority Data

Jan. 29, 2019 (JP) ..... JP2019-012825

(51) Int. Cl.
*B41J 2/14* (2006.01)
*B41J 2/175* (2006.01)

(52) U.S. Cl.
CPC ..... *B41J 2/14145* (2013.01); *B41J 2/14201* (2013.01); *B41J 2/17563* (2013.01); *B41J 2/17596* (2013.01); *B41J 2002/14306* (2013.01)

(58) Field of Classification Search
CPC .. B41J 2/14032; B41J 2/1404; B41J 2/14145; B41J 2/14201; B41J 2/14233; B41J 2002/14306; B41J 2002/14241; B41J 2002/14419; B41J 2202/12; B41J 2/19; B41J 2/18; B41J 2/01; B41J 29/38
See application file for complete search history.

(56) References Cited

U.S. PATENT DOCUMENTS

2009/0051724 A1* 2/2009 Katoh ..... B41J 2/145 347/18
2010/0073437 A1* 3/2010 Shibata ..... B41J 2/17509 347/85
2011/0057992 A1* 3/2011 Tobita ..... B41J 2/1623 347/54
2012/0176450 A1 7/2012 Akahane et al.
2015/0091960 A1* 4/2015 Nakazawa ..... B41J 2/0451 347/10
2015/0145929 A1 5/2015 Ikeda

FOREIGN PATENT DOCUMENTS

JP 2012-143948 8/2012

* cited by examiner

*Primary Examiner* — Kristal Feggins
(74) *Attorney, Agent, or Firm* — Workman Nydegger

(57) ABSTRACT

The liquid discharge head is configured to switch between a first mode in which the liquid supplied into the common liquid chamber is discharged through the individual flow channel from the outlet and a second mode in which the liquid supplied into the common liquid chamber is discharged from the outlet without passing through the individual flow channel.

14 Claims, 12 Drawing Sheets

LIQUID DISCHARGE HEAD, LIQUID DISCHARGE APPARATUS, METHOD OF CONTROLLING THE LIQUID DISCHARGE HEAD, AND A METHOD OF CONTROLLING THE LIQUID DISCHARGE APPARATUS

The present application is based on, and claims priority from JP Application Serial Number 2019-012825, filed Jan. 29, 2019, the disclosure of which is hereby incorporated by reference herein in its entirety.

BACKGROUND

1. Technical Field

The present disclosure relates to a liquid discharge head such as an ink jet recording head and a liquid discharge apparatus having the liquid discharge head. In particular, the present disclosure relates to a liquid discharge head through which liquid is circulated toward a liquid storing member, a liquid discharge apparatus, a method of controlling the liquid discharge head, and a method of controlling the liquid discharge apparatus.

2. Related Art

Liquid discharge apparatuses include a liquid discharge head, and from the liquid discharge head, discharge (eject) various kinds of liquids as liquid droplets. Examples of the liquid discharge apparatus include image recording apparatuses such as ink jet printers and ink jet plotters. Such liquid discharge apparatuses can accurately discharge a very small amount of liquid at predetermined positions and thus the liquid discharge apparatuses have been used as various manufacturing apparatuses in recent years. These applications include, for example, display manufacturing apparatuses for manufacturing color filters such as liquid crystal displays, electrode forming apparatuses for forming electrodes for organic electroluminescence (EL) displays and field emission displays (FEDs), and chip manufacturing apparatuses for manufacturing biochips (biochemical chips). For example, recording heads for image recording apparatuses discharge a liquid containing a coloring material, and color material discharging heads for manufacturing displays discharge liquids containing coloring materials of red (R), green (G), blue (B), and the like. Electrode-material discharge heads for electrode-forming apparatuses discharge liquids containing electrode materials, and bioorganic-compound discharge heads for chip manufacturing apparatuses discharge liquids containing bioorganic compounds.

Some of the above-described liquid discharge heads include a nozzle plate having a plurality of nozzles aligned in parallel therein, a plate having a plurality of pressure chambers (may be referred to as pressure generation chambers or cavities) communicating with corresponding nozzles, a plate having a common liquid chamber (may be referred to as a reservoir or a manifold) that is commonly used by the pressure chambers and into which a liquid from a liquid storage member is drawn, and pressure generating elements (may be referred to as driving elements or actuators) such as piezoelectric elements that cause pressure vibration, that is, pressure change, to the liquid in the pressure chambers. Some other liquid discharge heads may employ a structure having a circulation flow channel communicating with pressure chambers and nozzles, and a liquid circulates through a liquid storage member and the liquid ejecting head (for example, see JP-A-2012-143948). In the structure in JP-A-2012-143948, an ink drawn from an inlet, which is provided on one end in the nozzle arrangement direction, into a common liquid chamber passes through individual flow channels such as ink supply paths and pressure generating chambers (may be referred to as pressure chambers) for individual nozzles, flows into a circulation flow channel, and is discharged from a discharge path, which is provided on the other end in the nozzle arrangement direction in the circulation flow channel.

In this structure, however, when bubbles are trapped in the common liquid chamber, it is difficult to discharge the bubbles from the common liquid chamber because the flow channel cross-sectional area of the individual flow channels is narrower than other portions and this prevents the bubbles from readily passing through the individual flow channels.

SUMMARY

According to an aspect of the present disclosure, a liquid discharge head includes an individual flow channel having a nozzle and a pressure chamber communicating with the nozzle, a common liquid chamber having an inlet configured to receive a liquid and an outlet configured to discharge the liquid, the common liquid chamber coupled to a plurality of individual flow channels, each of which is the individual flow channel having the nozzle and the pressure chamber communicating with the nozzle, to supply the liquid to the individual flow channel, and the liquid is discharged from the individual flow channel, and a pressure generating element configured to cause fluctuations in pressure to the liquid in the pressure chamber, in which the liquid discharge head is configured to switch between a first mode in which the liquid supplied into the common liquid chamber is discharged through the individual flow channel from the outlet and a second mode in which the liquid supplied into the common liquid chamber is discharged from the outlet without passing through the individual flow channel (first structure).

A liquid discharge head according to an aspect of the present disclosure switches a mode between a first mode and a second mode, and thereby the liquid flow in a common liquid chamber can be changed. Accordingly, staying of liquid in the common liquid chamber can be reduced, and even when bubbles are trapped in the common liquid chamber, the bubbles can be readily discharged from the common liquid chamber.

In the first structure, the inlet in the common liquid chamber may include a first inlet configured to receive the liquid in the first mode, and a second inlet configured to receive the liquid in the second mode (second structure).

With this structure, a first inlet for the first mode and a second inlet for the second mode are provided respectively, and thus the liquid is less likely to stay. Accordingly, the bubble discharge performance can be increased.

In the second structure, the second inlet may be disposed at a position farther than the first inlet with respect to a central portion of the common liquid chamber in a first direction in which the individual flow channels are aligned in parallel (third structure).

In this structure, since the second inlet is closer to an end portion of the common liquid chamber in a first direction, a flow can be produced in the first direction in the common liquid chamber, and thus the liquid is less likely to stay. Furthermore, since the first inlet is closer to a central portion of the common liquid chamber in the first direction, the liquid supply pressure can be further evenly applied to the nozzles in the first mode.

In the second structure or the third structure, the outlet may include a first outlet from which the liquid is discharged in the first mode, the first outlet being disposed across the individual flow channel from the first inlet, and in the first direction in which the individual flow channels are aligned in parallel, a distance between the first inlet and the first outlet is shorter than a distance between the first inlet and the second inlet (fourth structure).

In this structure, since a distance between the first inlet and the first outlet is shorter in the first direction, the liquid supply pressure can be further evenly applied to the nozzles in the first mode.

In the fourth structure, the common liquid chamber may include a first common liquid chamber having the first inlet and a second common liquid chamber having the first outlet, the second common liquid chamber being disposed across the individual flow channel from the first common liquid chamber (fifth structure).

Furthermore, in any one of the first to fifth structures, the liquid discharge apparatus may include a first circulation flow channel configured to supply the liquid discharged from the common liquid chamber to the common liquid chamber in the first mode and a second circulation flow channel configured to supply the liquid discharged from the common liquid chamber to the common liquid chamber in the second mode. (sixth structure).

In this structure, in both modes, liquid discharged from the common liquid chamber is supplied again to the common liquid chamber, and thus the liquid consumption can be reduced while liquid thickening and sedimentation of liquid components can be suppressed.

In the sixth structure, a heater configured to heat the liquid flowing through the second circulation flow channel may be provided (seventh structure).

In this structure, the liquid flowing through the second circulation flow channel can be heated by a heater, and the liquid viscosity adjustment can be performed.

In the seventh structure, viscosity of the liquid at 25° C. may be 20 mPa·s or more and 200 mPs·s or less (eighth structure).

With this structure, a liquid that has a relatively high viscosity of 20 mPa·s or more and 200 mPs·s or less can be adjusted to a viscosity suitable for the discharge from the nozzles.

A liquid discharge apparatus according to another aspect of the present disclosure includes the liquid discharge head according to any one of the sixth to eighth structures, a first storage member configured to store the liquid to which a pressure higher than a pressure applied to the liquid in the nozzle is applied, the first storage member being disposed in the first circulation flow channel, a second storage member configured to store the liquid to which a pressure lower than a pressure applied to the liquid in the nozzles is applied, the second storage member being disposed in the first circulation flow channel, and a filter configured to filter the liquid flowing through the second circulation flow channel (ninth structure).

With this structure, in the first mode, liquid discharge operations can be performed while liquid thickening and sedimentation of liquid components are suppressed, and when bubbles are trapped in the common liquid chamber, the first mode can be switched to the second mode to remove the bubbles, and thus the bubble discharge performance can be increased.

In the ninth structure, a coupling flow channel configured to pass a bubble caught by the filter toward the first circulation flow channel may be provided (tenth structure).

With this structure, bubbles caught by the filter can be removed through the first circulation flow channel.

The tenth structure may include a unidirectional valve disposed between a point of coupling with the coupling flow channel and the second storage member in the first circulation flow channel, the unidirectional valve being configured to allow the liquid to flow from the point of coupling toward the second storage member but prevent the liquid from flowing from the second storage member toward the point of coupling (eleventh structure).

With this structure, when the mode is switched to the second mode, the liquid can be prevented from being drawn from the second storage member side into the second circulation flow channel. With this structure, the liquid in the common liquid chamber can more readily flow toward the second circulation flow channel, and thus the bubble discharge performance can be increased.

In any one of the ninth to eleventh structures, a pump configured to feed the liquid through the second circulation flow channel may be provided, and the filler may be disposed between a discharge position of the liquid in the common liquid chamber and the pump in the second circulation flow channel (twelfth structure).

In this structure, when the pump is driven, the pressure between the liquid outlet position in the common liquid chamber and the pump is lower than the pressure between the pump and the liquid supply position in the common liquid chamber, and thus the resistance of the filter for catching bubbles can be lowered. Accordingly, the performance of the pump can be set to a low level. This structure thus enables easier regulation of the resistance to the pressure to the liquid in the nozzles.

A method of controlling the liquid discharge head according to any one of the above-described structures includes switching between the first mode in which the liquid supplied into the common liquid chamber is discharged through the individual flow channel from the outlet and the second mode in which the liquid supplied into the common liquid chamber is discharged from the outlet without passing through the individual flow channel (first control method).

A method of controlling the liquid discharge apparatus according to any one of the above-described structures includes switching between the first mode in which the liquid supplied into the common liquid chamber is discharged through the individual flow channel from the outlet and the second mode in which the liquid supplied into the common liquid chamber is discharged from the outlet without passing through the individual flow channel (second control method).

The control methods switch a mode between a first mode and a second mode, and thereby the liquid flow in a common liquid chamber can be changed. Accordingly, staying of liquid in the common liquid chamber can be reduced, and even when bubbles are trapped in the common liquid chamber, the bubbles can be readily discharged from the common liquid chamber.

DESCRIPTION OF EXEMPLARY EMBODIMENTS

Hereinafter, embodiments of the present disclosure will be described with reference to the attached drawings. Although various limitations are given in the embodiments described below in order to illustrate specific preferred examples of the disclosure, it should be noted that the scope of the disclosure is not intended to be limited to the embodiments unless such limitations are explicitly mentioned hereinafter. In the description below, as an example liquid discharge apparatus according to an embodiment of the present disclosure, an ink jet recording apparatus (hereinafter, referred to as a printer) 1 including an ink jet recording head (hereinafter, referred to as a recording head) 2 that is an example liquid discharge head will be described.

Figure 1:
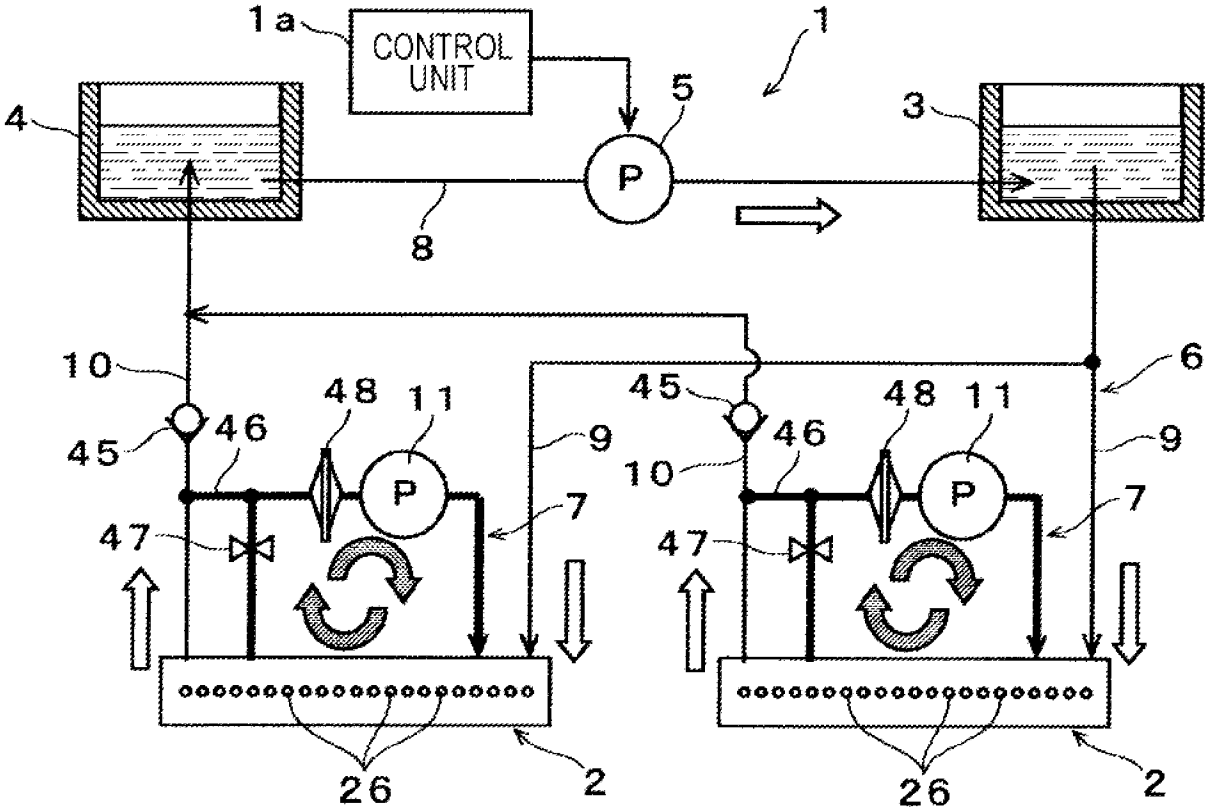
FIG. 1 is a schematic view of a circulation path of a liquid in a liquid discharge apparatus according to an embodiment.

FIG. 1 is a schematic view mainly illustrating a circulation path of an ink in the printer 1 according to an embodiment. The printer 1 according to the embodiment is an ink jet printing apparatus that discharges droplets of an ink, which is an example liquid, onto a medium such as recording paper to print an image or the like with the dots formed on the medium. In the description below, in an X direction, a Y direction, and a Z direction that are orthogonal to each other, the X direction denotes a direction that is orthogonal to a direction (nozzle array direction) in which nozzles 26 of the recording head 2, which will be described below, are aligned in parallel, the Y direction denotes the nozzle array direction (first direction according to the embodiments of the present disclosure), and the Z direction denotes a direction orthogonal to an XY plane.

The printer 1 includes the recording head 2, a main tank 3 (example first storage member according to the embodiments of the present disclosure), a sub tank 4 (example second storage member according to the embodiments of the present disclosure), a main pump 5, a first circulation flow channel 6, a second circulation flow channel 7, and a control unit 1*a*. FIG. 1 illustrates a structure for one color (one kind) of ink, and when a structure for multiple kinds of ink is employed, each structure is provided for each ink and the control unit 1*a* is commonly used among the structures. FIG. 1 illustrates two recording heads 2; however, the number of the recording heads 2 may be one or three or greater. The control unit 1*a* includes, for example, a processing circuit such as a central processing unit (CPU) or a field-programmable gate array (FPGA), and a storage circuit such as a semiconductor memory. The control unit 1*a* performs overall control of components in the printer 1 including the main pump 5, a sub pump 11, and the recording heads 2. The main tank 3 is a liquid storage member for storing an ink to be discharged from the recording heads 2. The sub tank 4 is a liquid storage member for storing an ink discharged from the recording heads 2. The main tank 3 and the sub tank 4 are coupled to each other by a return flow channel 8. To the main tank 3, an ink is supplied from a refill container (not illustrated).

A first circulation flow channel 6 includes inlet channels 9 that couple the main tank 3 and the recording heads 2, outlet channels 10 that couple the recording heads 2 and the sub tank 4, and the return flow channel 8. The first circulation flow channel 6 is operated by driving the main pump 5, which serves as a liquid feeding mechanism, to circulate an ink through each recording head 2 and the sub tank 4. The main pump 5 is, for example, a tube pump, and in this embodiment, disposed in the return flow channel 8. The position of the main pump 5 is not limited to the position in the return flow channel 8, and the main pump 5 may be disposed any position in the first circulation flow channel 6. In a first mode, by driving the main pump 5, an ink is circulated through the first circulation flow channel 6. Although not illustrated in the inlet channels 9, which couple the main tank 3 and the recording heads 2, a filter for filtering an ink, a mechanism for regulating the pressure for supplying an ink to each recording head 2, and other components may be disposed. Furthermore, the circulation in the first circulation flow channel 6 may be performed by pressure control in the main tank 3 or the sub tank 4, not by the main pump 5.

The second circulation flow channel 7 is provided for each recording head 2 to circulate an ink for each recording head 2. In a second mode, by driving the sub pump 11 provided for each second circulation flow channel 7, an ink is circulated through the second circulation flow channel 7. The control unit 1*a* controls switching of the ink circulation in the first mode and the ink circulation in the second mode. The second circulation flow channel 7 and the sub pump 11 may be provided in each recording head 2 as a part of the structure of the recording head 2, or may be provided as a part of the printer 1.

The recording head 2 according to the embodiment is provided for each color of ink stored in the main tank 3, and discharges the ink supplied from the main tank 3 through the inlet channel 9 from the nozzles 26 onto a medium under the control of the control unit 1*a*. The recording head 2 according to the embodiment includes a nozzle array of the nozzles 26 aligned in parallel in the Y direction.

Figure 2:
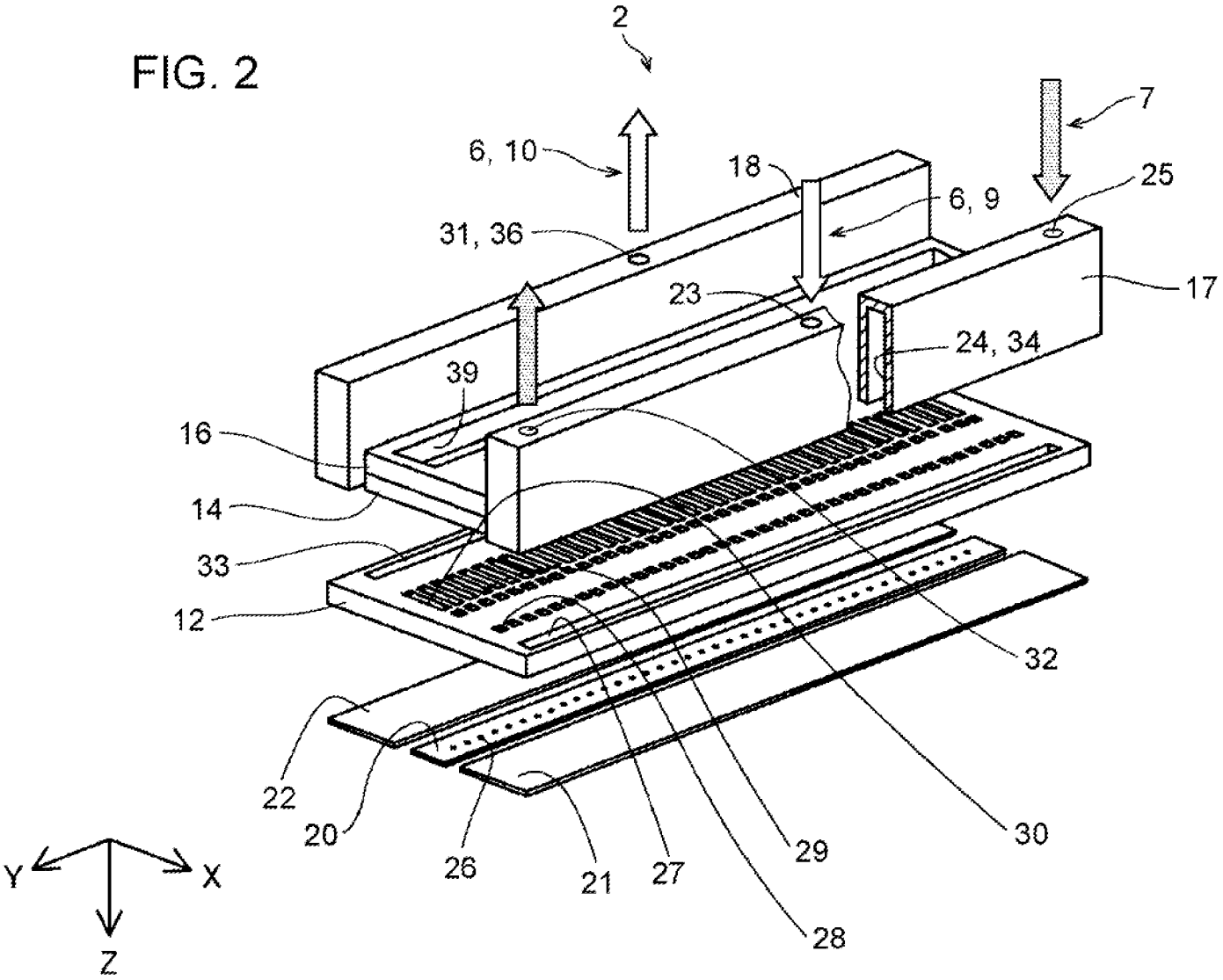
FIG. 2 is an exploded perspective view of a structure of a liquid discharge head according to an embodiment.
Figure 3:
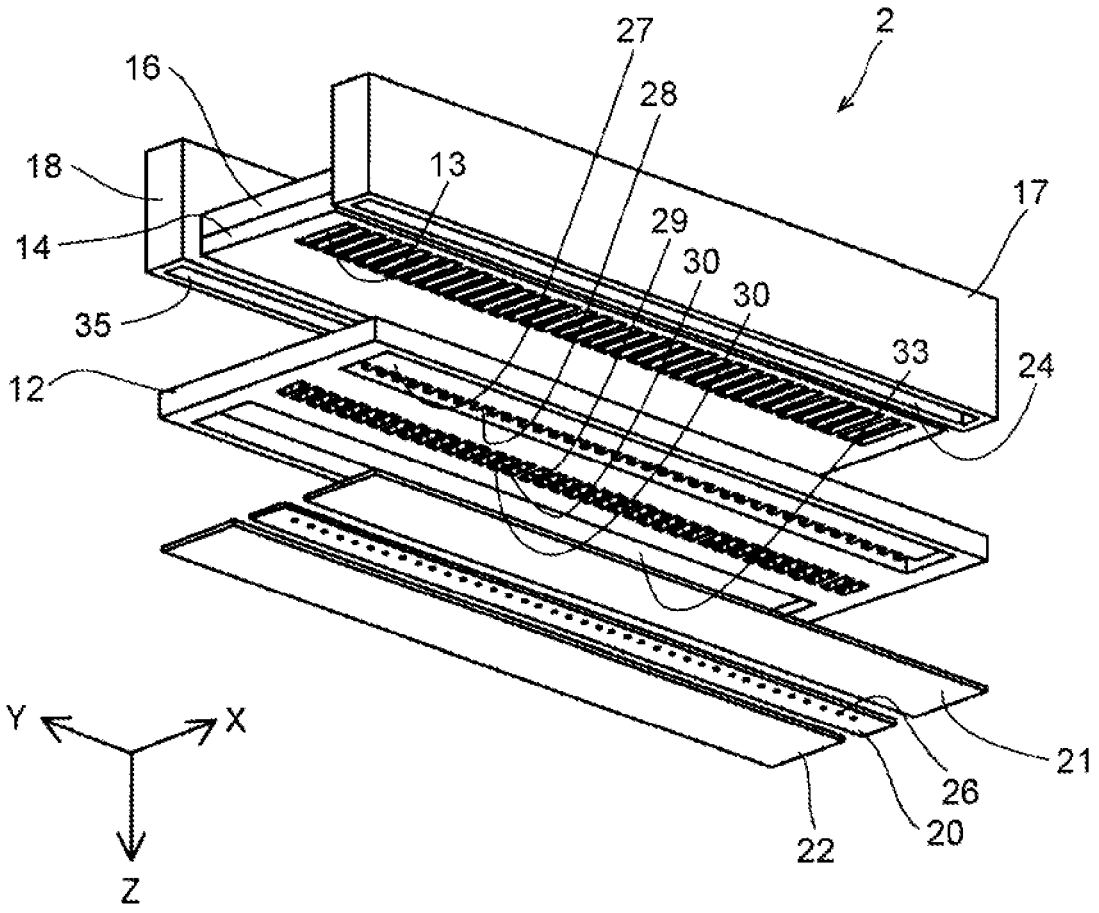
FIG. 3 is an exploded perspective view of a structure of a liquid discharge head according to an embodiment.
Figure 4:
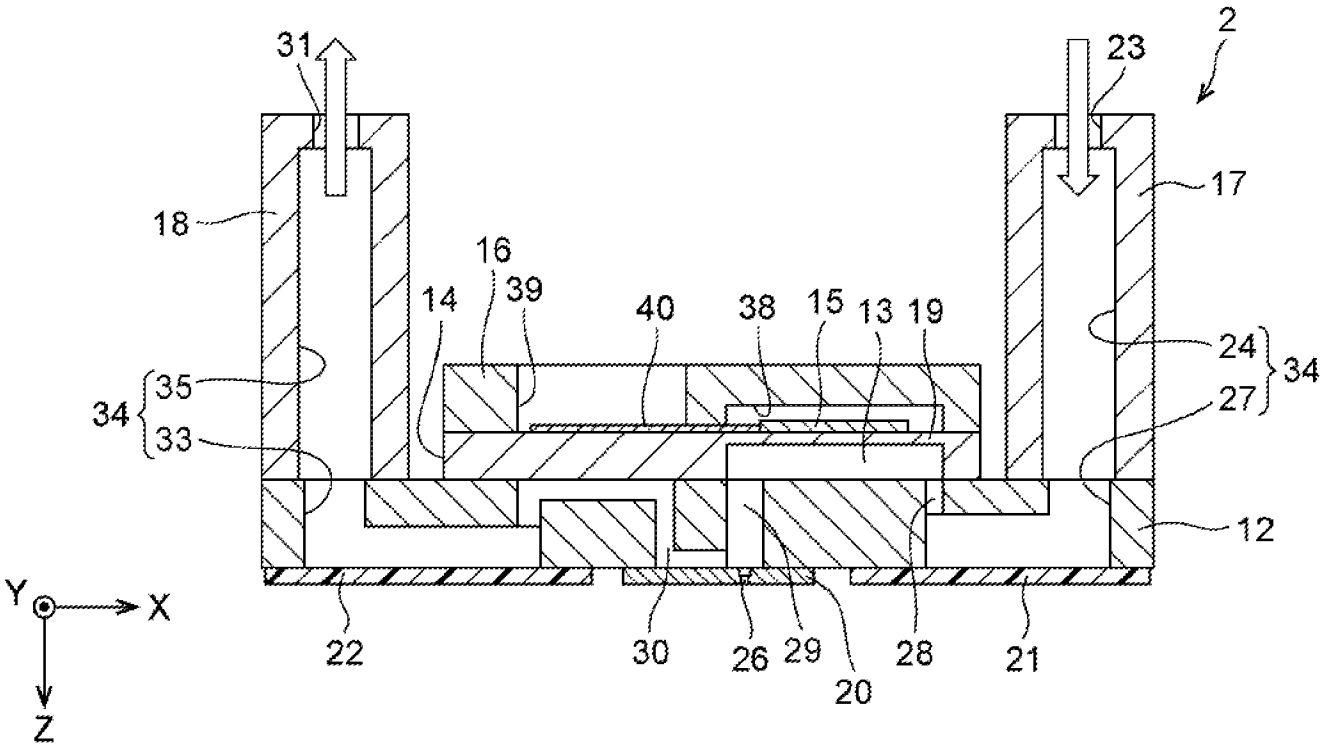
FIG. 4 is a cross-sectional view illustrating a liquid discharge head in an X direction.
Figure 5:
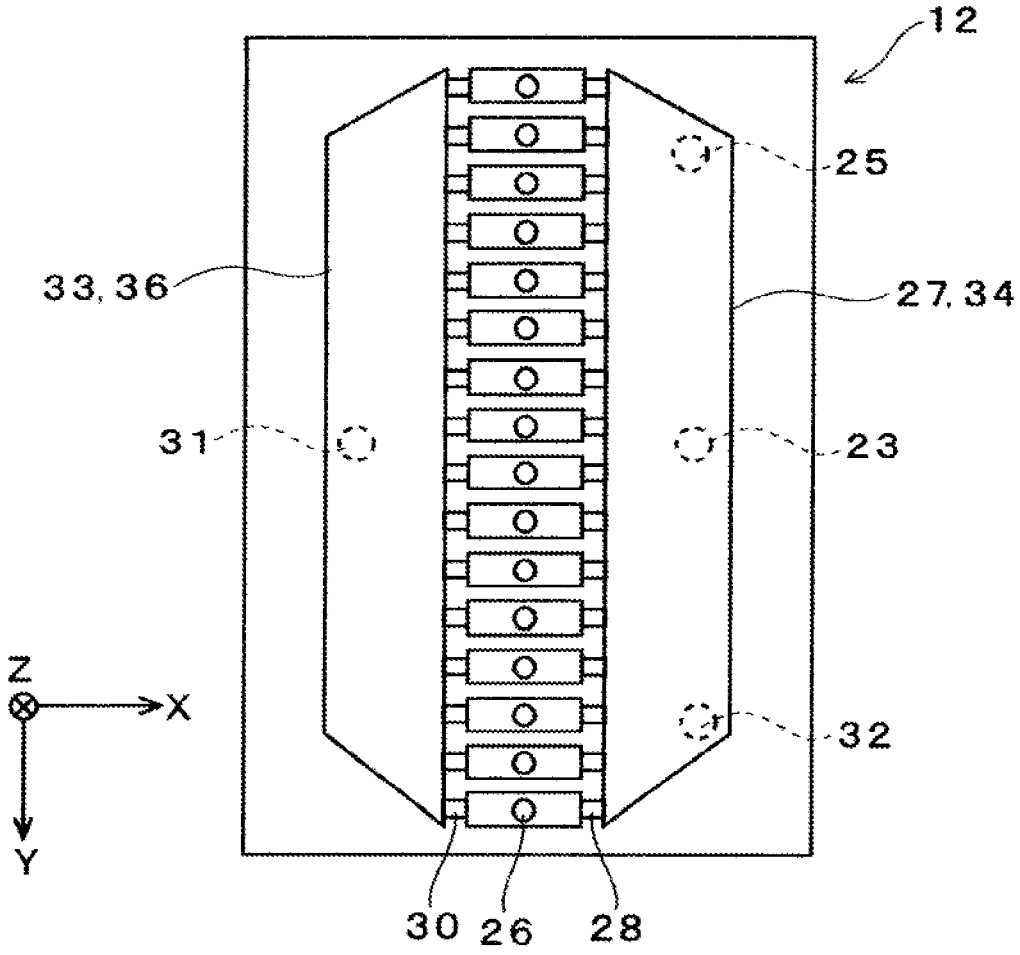
FIG. 5 is a schematic plan view illustrating a flow channel plate.

FIG. 2 is an exploded perspective view of the recording head 2 viewed obliquely from above. FIG. 3 is an exploded perspective view of the recording head 2 viewed obliquely from below. FIG. 4 is a cross-sectional view of the recording head 2 in the X direction. FIG. 5 is a schematic plan view of the flow channel plate 12. The recording head 2 according to the embodiment includes the flow channel plate 12 that has various flow channels, a pressure chamber plate 14 that has a pressure chamber 13, a protection plate 16 that protects a piezoelectric element 15, an inlet channel plate 17 that has a first inlet 23 that is coupled to the inlet channel 9, and an outlet channel plate 18 that has a first outlet 31 that is coupled to the outlet channel 10. Although the inlet channel plate 17 and the outlet channel plate 18 according to the embodiment are separate parts, the structure is not limited thereto, and may be integrally formed. The flow channel plate 12 may be a single plate or a stack that has a plurality of layers. The flow channel plate 12 may have the pressure chamber 13 without providing the pressure chamber plate 14.

The flow channel plate 12 according to the embodiment is a plate material longer in the Y direction than in the X direction in plan view from the Z direction. To edges of an upper surface of the flow channel plate 12 in a widthwise direction, which is the X direction in this embodiment, the inlet channel plate 17 and the outlet channel plate 18 are attached respectively, and to a region between the inlet channel plate 17 and the outlet channel plate 18, the pressure chamber plate 14 and the protection plate 16 are fixed in a laminated state. A nozzle plate 20 is joined to a central portion of a lower surface of the flow channel plate 12 in the X direction, and a first compliance plate 21 and a second compliance plate 22 are joined such that the nozzle plate 20 is interposed therebetween.

The inlet channel plate 17 is a member that has an inlet liquid chamber 24 therein. The inlet liquid chamber 24 is open in a lower surface of the inlet channel plate 17 and the opening is blocked by the flow channel plate 12 and thereby the inlet liquid chamber 24 communicates with a first liquid chamber 27 in the flow channel plate 12. The first liquid chamber 27 and the inlet liquid chamber 24 communicate with each other and thereby a first common liquid chamber 34 (a common liquid chamber according to the embodiment of the present disclosure) is defined. The first inlet 23 is open at a central portion of an upper surface of the inlet channel plate 17 in the Y direction. In the upper surface of the inlet channel plate 17, a second inlet 25 that is coupled to the second circulation flow channel 7 is open at one end portion in the Y direction. A second outlet 32 that is coupled to the second circulation flow channel 7 is open at the other end portion in the Y direction. The second inlet 25 is farther than the first inlet 23 with respect to a central portion of the first common liquid chamber 34 in the Y direction, that is, closer to the end portion of the first common liquid chamber 34 in the Y direction.

An ink supplied from the main tank 3 through the inlet channel 9 of the first circulation flow channel 6 by the driving of the main pump 5 in the first mode is supplied through the first inlet 23 toward the first common liquid chamber 34 as illustrated by the white background arrow in FIG. 2 and FIG. 4. In the second mode, the ink in the first common liquid chamber 34 is fed from the second outlet 32 to the second circulation flow channel 7 and supplied again through the second inlet 25 to the inlet liquid chamber 24 as illustrated by the hatched arrow in FIG. 2. As described above, the first common liquid chamber 34 has the first inlet 23 in which ink is supplied in the first mode and the second inlet 25 in which ink is supplied in the second mode, and thus the flow of the ink can be changed in the first mode and the second mode. With this structure, the ink less likely to stay in the first common liquid chamber 34. Accordingly, the portions where the ink is likely to stay in the first common liquid chamber 34 can be reduced. As a result, bubbles are less likely to stay in the first common liquid chamber 34, and thus increases the bubble discharge performance. Furthermore, since the second inlet 25 is closer than the first inlet 23 to the end portion of the first common liquid chamber 34 in the Y direction, a flow can be produced from one end portion toward the other end portion in the first common liquid chamber 34 in the first direction, and thus the ink is less likely to stay. Consequently, this structure further increases the bubble discharge performance. Furthermore, since the first inlet 23 is close to the central portion of the first common liquid chamber 34 in the first direction, the ink supply pressure can be further evenly applied to the nozzles 26. Accordingly, variations in the discharge characteristics of the nozzles 26, that is, the amounts of discharged ink droplets, the flying speeds, and the like can be reduced.

The flow channel plate 12 according to the embodiment is, for example, a single substrate made of a silicon single crystal substrate, or the like. The flow channel plate 12 has, from the side on which the inlet channel plate 17 is joined, the first liquid chamber 27, which communicates with the inlet liquid chamber 24, a first individual communication channel 28, a nozzle communication channel 29, a second individual communication channel 30, and a second liquid chamber 33.

The first liquid chamber 27 extends along the nozzle array direction of the nozzles 26, that is, along the Y direction, and is a liquid chamber that communicates with a plurality of pressure chambers 13. Specifically, the first liquid chamber 27 is a liquid chamber that is commonly used for ink supply to the nozzles 26. The opening of the first liquid chamber 27 on the upper surface of the flow channel plate 12 communicates with the inlet liquid chamber 24 in the inlet channel plate 17. The opening of the first liquid chamber 27 on the lower surface of the flow channel plate 12 is blocked by the first compliance plate 21, which will be described below, joined to the lower surface. A plurality of first individual communication channels 28 are provided to correspond to the pressure chambers 13 respectively, and are flow channels that communicate with the pressure chambers 13 in the pressure chamber plate 14 and the first liquid chamber 27 (the first common liquid chamber 34). The first individual communication channels 28 communicate from the first common liquid chamber 34 to the pressure chambers 13. The first individual communication channel 28 has a flow channel cross-sectional area smaller than those of other parts in the flow channel from the main tank 3 toward the pressure chamber 13, and thereby a flow channel resistance is applied to the ink passing through the first individual communication channel 28.

The pressure chamber 13 in the pressure chamber plate 14 is a liquid chamber long in the X direction and is open in the lower surface of the pressure chamber plate 14. The pressure chamber plate 14 is joined to the upper surface of the flow channel plate 12, blocking the opening and defining the pressure chamber 13. In the pressure chamber plate 14, on the upper surface side of the pressure chamber 13, a flexible diaphragm 19 is provided. The diaphragm 19 is a thin-plate like portion that can be deformed in response to the drive of the piezoelectric element 15 that serves as a pressure generating element. On areas of the diaphragm 19 corresponding to the pressure chambers 13, the piezoelectric elements 15 are formed respectively. The piezoelectric elements 15 correspond to the pressure chambers 13, and serve as drive elements that deform in accordance with drive signals from the control unit 1*a*. The deformation of the piezoelectric elements 15 causes the diaphragm 19 to deform, changing the volume of the pressure chambers 13, and thereby pressure vibrations, that is, pressure variations occur in the ink in the pressure chamber 13. The recording head 2 uses the pressure vibrations to discharge liquid droplets, that is, ink droplets, from the nozzles 26. The pressure generating element is not limited to the above-described piezoelectric element 15, and may be a piezoelectric actuator that has a laminated piezoelectric element or a thin film piezoelectric element, a thermal actuator that employs an electrothermal conversion element such as a heating resistor, or an electrostatic actuator that has a diaphragm and a counter electrode.

The first compliance plate 21 absorbs the pressure vibrations that propagate from the pressure chambers 13 to the inside of the first common liquid chamber 34 in discharging ink droplets from the nozzles 26 to suppress variations in the discharge characteristics (the amount of ink droplets, the discharge speed, and the like) of the nozzles 26. Each of the first compliance plate 21 and the second compliance plate 22, which will be described below, has a flexible thin film (not illustrated) made of, for example, polyphenylene sulfide (PPS), aromatic polyamide (aramid), or the like. This thin film deforms in accordance with the pressure vibrations of the ink in the liquid chamber, and absorbs the pressure vibrations. The first compliance plate 21 and the second compliance plate 22 are not limited to the above-described film, and may have other shapes or members for absorbing the pressure vibrations in the first common liquid chamber 34 and a second common liquid chamber 36. Furthermore, the liquid chambers may be blocked by the nozzle plate 20 without providing the first compliance plate 21 and the second compliance plate 22.

The nozzle communication channel 29 in the flow channel plate 12 is a through hole in the thickness direction in the flow channel plate 12, and causes the nozzle 26 in the nozzle plate 20, which is joined to the lower surface of the flow channel plate 12, and the pressure chamber 13, which corresponds to the nozzle 26 to communicate with each other on the side of the other end of the pressure chamber.

The nozzle plate 20 is joined to the lower surface of the flow channel plate 12 to block the openings of the nozzle communication channels 29 and the second individual communication channels 30, which will be described below. The nozzle plate 20 according to the embodiment has the nozzles 26 that are aligned in parallel, for example, by dry etching, wet etching, or the like performed to a single crystal substrate of silicon (Si). The nozzle 26 is a circular through hole for discharging ink; however, may have any known shape.

The second individual communication channel 30 is a flow channel that corresponds to the individual nozzle 26, and has a groove shape made by wet etching or the like performed to the flow channel plate 12. One end of the second individual communication channel 30 communicates with the nozzle communication channel 29 that communicates with the pressure chamber 13 and the nozzle 26, and the other end of the second individual communication channel 30 communicates with the second liquid chamber 33, that is, the second common liquid chamber 36. The first individual communication channel 28, the pressure chamber 13, the nozzle communication channel 29, and the second individual communication channel 30 according to the embodiment are individual channels provided for each nozzle 26.

The second liquid chamber 33 extends along the Y direction, and communicates with the nozzles 26 through the second individual communication channels 30. The opening of the second liquid chamber 33 on the upper surface side of the flow channel plate 12 communicates with the outlet liquid chamber 35 in the outlet flow channel plate 18. The second liquid chamber 33 and the outlet liquid chamber 35 communicate with each other and thereby the second common liquid chamber 36 (a common liquid chamber according to the embodiment of the present disclosure) is defined. The opening of the second liquid chamber 33 on the lower surface of the flow channel plate 12 is blocked by the second compliance plate 22. The second compliance plate 22 absorbs the pressure vibrations that propagate from the pressure chambers 13 to the inside of the second common liquid chamber 36 in discharging ink droplets from the nozzles 26.

The outlet channel plate 18 is a member that has the outlet liquid chamber 35 therein. The opening of the outlet liquid chamber 35 on the lower surface side of the outlet channel plate 18 communicates with the second liquid chamber 33 in the flow channel plate 12 and thereby the second common liquid chamber 36 is defined. In the first mode, the ink drawn from the first common liquid chamber 34 by the driving of the main pump 5 through the individual flow channels into the second common liquid chamber 36 is fed through the first outlet 31, which is in the upper surface of the outlet channel plate 18, to the outlet channel 10 in the first circulation flow channel 6 and is returned to the sub tank 4. The ink is further fed from the sub tank 4 through the return flow channel 8 to the main tank 3. In this embodiment, the first outlet 31 is disposed across the individual flow channel from the first inlet 23, and in the Y direction, the distance between the first inlet 23 and the first outlet 31 is shorter than the distance between the first inlet 23 and the second inlet 25. With this structure, in the first mode, the pressure for supplying an ink to the nozzles 26 can be further evenly applied irrespective of the positions in the nozzle array. Accordingly, variations in the discharge characteristics of the nozzles 26 can be reduced.

The protection plate 16 has concave housing spaces 38 that correspond to the areas where the piezoelectric elements 15 are provided on the diaphragm 19 in the pressure chamber plate 14. The protection plate 16 is joined to the upper surface of the pressure chamber plate 14 in a state in which the piezoelectric elements 15 are housed in the housing spaces 38. The protection plate 16 has a wiring through hole 39 that is a through hole extending in the plate thickness direction and is used for installation of a wiring board (not illustrated) coupled to lead electrodes 40 extending from the piezoelectric elements 15.

As described above, in the recording head 2 that has the first inlet 23, the second inlet 25, the first outlet 31, and the second outlet 32, the ink circulation in the first mode and the ink circulation in the second mode can be switched. In printing operation, the first mode is set and the ink is circulated through the first circulation flow channel 6 among the main tank 3 and the sub tank 4 and the recording heads 2. In the first mode, in response to the driving of the piezoelectric elements 15 in accordance with the waveforms of a drive signal from the control unit 1*a*, the diaphragms 19 are deformed, and the volume in the pressure chambers 13 is changed, and thereby pressure vibrations, that is, pressure vibrations occur in the ink in the pressure chambers 13. The pressure vibrations propagate from the pressure chambers 13 toward the nozzles 26, and when the pressure vibrations become maximum, the ink is discharged from the nozzles 26 as ink droplets. The ink that was not discharged from the nozzles 26 is fed through the individual flow channels to the second common liquid chamber 36, and is discharged from the first outlet 31 toward the sub tank 4. At a predetermined time in a state in which no print operation is performed, as maintenance processing for removing bubbles in the first common liquid chamber 34, the mode is switched to the second mode to circulate the ink in the second circulation flow channel 7 through the second inlet 25 and the second outlet 32 in the first common liquid chamber 34.

As described above, the first common liquid chamber 34, the individual flow channels, and the second common liquid chamber 36 in the recording head 2 are a part of the first circulation flow channel 6. Similarly, the first common liquid chamber 34 in the recording head 2 is a part of the second circulation flow channel 7. By the switching between the first mode and the second mode, in each recording head 2, the ink flow in the first common liquid chamber 34 can be changed. In the first mode, an ink flow is produced from the first inlet 23 of the first common liquid chamber 34 through the individual flow channels toward the first outlet 31 of the second common liquid chamber 36, whereas in the second mode, an ink flow is produced from the second inlet 25 of the first common liquid chamber 34 along the Y direction toward the second outlet 32. Accordingly, staying of ink in the first common liquid chamber 34, in particular, staying of ink at end portions in the first common liquid chamber 34 in the Y direction can be reduced, resulting in increased performance in discharging bubbles from the first common liquid chamber 34 even if bubbles are trapped in the first common liquid chamber 34.

The ink circulation flow channels will be described in detail below. In the first circulation flow channel 6, ink is circulated through the main tank 3, the recording heads 2, and the sub tank 4 in response to the driving of the main pump 5 in the first mode as described above. When the main pump 5 is driven in the first mode, the pressure to the ink stored in the main tank 3 per unit area is higher than the pressure to the ink in the nozzles 26 per unit area, that is, the ink is being pressurized. On the other hand, the pressure to the ink stored in the sub tank 4 per unit area is lower than the pressure to the ink in the nozzles 26 per unit area, that is, the pressure is reduced. The pressure difference causes the ink to circulate through the first circulation flow channel 6. The inlet channel 9, which is coupled to the main tank 3, is branched to correspond to the recording heads 2, and the branched ends are coupled to the first inlets 23 of the corresponding recording heads 2. The outlet channels 10 that are coupled to the first outlets 31 of the recording heads 2 are combined into one flow channel, and the end is coupled to the sub tank 4. In the outlet channel 10, a check valve 45 is disposed on a downstream side of a point of coupling with a coupling flow channel 46, which will be described below, that is, on the sub tank 4 side. The check valve 45 is a unidirectional valve that allows the flow of ink from the recording head 2 side toward the sub tank 4 side, whereas the check valve 45 prevents the flow of ink from the sub tank 4 side toward the recording head 2 side.

The second circulation flow channel 7 is provided for each recording head 2 to communicate with the second inlet 25 and the second outlet 32 in the first common liquid chamber 34. The second circulation flow channel 7 includes, in order from the second outlet 32 toward the first inlet 23, an on-off valve 47, a filter 48, and the sub pump 11 (a pump according to the embodiment of the present disclosure). The on-off valve 47 opens and closes the flow channel under the control of the control unit 1*a*. The filter 48 filters ink. The sub pump 11 is, for example, a peristaltic pump. One end of the coupling flow channel 46 is coupled between the on-off valve 47 and the filter 48, and the other end of the coupling flow channel 46 is coupled to the outlet channel 10 in the first circulation flow channel 6. The filter 48 is provided to catch bubbles in ink, and is disposed, in the second circulation flow channel 7, between the second outlet 32, which is an outlet position of the ink in the first common liquid chamber 34, and the sub pump 11. On the other hand, one end of the coupling flow channel 46 is coupled between the on-off valve 47 and the filter 48 in the second circulation flow channel 7, and the other end of the coupling flow channel 46 is coupled between the first outlet 31 of the recording head 2 and the check valve 45 in the first circulation flow channel 6.

In the second mode, when the sub pump 11 is driven, the pressure per unit area to the ink between the second outlet 32, which is the ink outlet position in the first common liquid chamber 34, and the sub pump 11 is lower than the pressure per unit area to the ink between the sub pump 11 and the second inlet 25, which is the ink supply position in the first common liquid chamber 34, and thus the resistance of the filter 48 for catching bubbles to the ink passing through the filter 48 can be lowered. As a result, the coarser filter 48 can be used. Accordingly, the performance of the sub pump 11 can be set to a low level. This structure thus enables easier regulation of the resistance to the pressure on the surface, or meniscus of the ink in the nozzles 26 in the second mode. For example, when the ink circulation is performed in the second mode, it can be prevented that the resistance to pressure to the meniscus on the pressure side in a nozzle 26 close to the second inlet 25 exceeds a predetermined level and the ink leaks from the nozzle 26. Furthermore, it can also be prevented that the resistance to pressure to the meniscus on the pressure-reduced side in a nozzle 26 close to the second outlet 32 exceeds a predetermined level and bubbles are drawn from the nozzle 26 into the pressure chamber.

In the first mode, the main pump 5 is driven to supply an ink from the main tank 3 through the inlet channel 9 and the first inlet 23 toward the first common liquid chamber 34, and the ink is fed through the above-described individual communication channels, that is, the first individual communication channels 28, the pressure chambers 13, the nozzle communication channels 29, and the second individual communication channels 30 toward the second common liquid chamber 36, and is discharged from the first outlet 31. The ink discharged from the first outlet 31 is drawn through the outlet channel 10 into the sub tank 4, and is returned through the return flow channel 8 to the main tank 3. The ink returned to the main tank 3 is supplied through the inlet channel 9 and the first inlet 23, to the first common liquid chamber 34. In this embodiment, in the first mode, the on-off valve 47 is closed, and the driving of the sub pump 11 is stopped. The ink circulation in the first mode continues during the execution of printing operation, that is, while the discharging of the ink from the nozzles 26 is performed. By the ink circulation, thickening of the ink and sedimentation of solid components such as pigments contained in the ink can be suppressed, and thus the high discharge performance of the nozzles 26 can be maintained.

In this structure, however, when bubbles are trapped in the first common liquid chamber 34 and the bubbles grow larger than the channel cross-sectional areas of the individual flow channels, it is difficult to discharge the bubbles from the first circulation flow channel 6 because the cross-sectional areas of the individual flow channels are narrowed. To solve the problem, in the printer 1 according to the embodiment of the present disclosure, as maintenance processing for removing bubbles in the first common liquid chamber 34, the mode is switched to the second mode to allow the ink in the first common liquid chamber 34 to circulate through the second circulation flow channel 7 to discharge bubbles in the first common liquid chamber 34. In the second mode, the drive of the main pump 5 is stopped, and the sub pump 11 is driven with the on-off valve 47 being opened to feed the ink in the first common liquid chamber 34 through the second outlet 32 to the second circulation flow channel 7, and the ink passes through the filter 48 and returns through the second inlet 25 to the first common liquid chamber 34. By the ink circulation in the second circulation flow channel 7, bubbles in the first common liquid chamber 34 are caught by the filter 48 and thereby bubbles trapped in the first common liquid chamber 34 can be removed. After the second mode is performed for a predetermined time period, the sub pump 11 is stopped and the on-off valve 47 is closed, and thereby the second mode ends.

The check valve 45 is disposed between the point of coupling of the coupling flow channel 46 with the first circulation flow channel 6, specifically, the outlet channel 10, and the sub tank 4 to prevent the ink from flowing backward from the sub tank 4 side in the second mode. With this structure, the ink in the first common liquid chamber 34 can more readily flow toward the second circulation flow channel 7, and when bubbles are trapped in the first common liquid chamber 34, the bubbles can be reliably caught by the filter 48, increasing the bubble discharge performance. The bubbles caught by the filter 48 is discharged from the coupling flow channel 46 through the outlet channel 10 toward the sub tank 4 by performing the first mode. The bubbles caught by the filter 48 can be removed through the first circulation flow channel 6. The second mode can be performed at any time, for example, before a print operation is executed, after a print operation is executed, or in an initial operation after the electric power is supplied to the printer 1.

As described above, in the printer 1 that includes the recording head 2 according to the embodiment of the present disclosure, the ink circulation mode can be switched between the first mode in which an ink supplied to the first common liquid chamber 34 is discharged from the first common liquid chamber 34 via the individual flow channels and the second mode in which an ink supplied to the first common liquid chamber 34 is discharged from the first common liquid chamber 34 without passing through the individual flow channels. With this structure, in the first mode, liquid discharge operations such as printing operations can be performed while ink thickening and sedimentation of ink components are suppressed, and when bubbles are trapped in the first common liquid chamber 34, which is on the upstream side (supply side) of the individual flow channels, the first mode can be switched to the second mode to remove the bubbles, and thus the bubble discharge performance can be increased. As a result, the number of maintenance operations such as cleaning operations and flushing operations for forcibly discharging ink inside the recording head 2 from the nozzles 26 can be reduced, and the amount of ink to be consumed by the maintenance operations can be reduced. Furthermore, in both modes, ink discharged from the common liquid chambers 34 and 36 is supplied again to the first common liquid chamber 34, and thus the ink consumption can be reduced while ink thickening and sedimentation of ink components are suppressed. In this embodiment, the first mode and the second mode are separately performed; however, in another example, the first mode and the second mode may be simultaneously performed.

Figure 6:
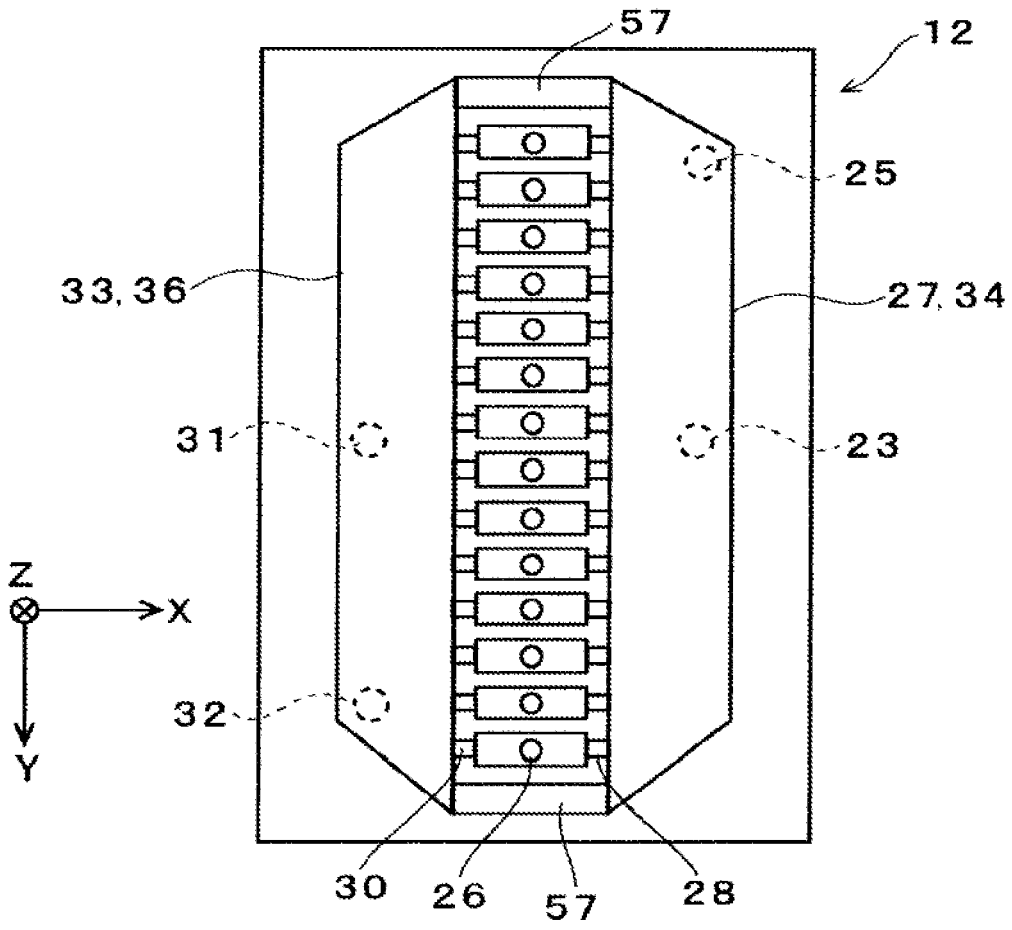
FIG. 6 is a schematic plan view illustrating a flow channel plate according to a modification.

FIG. 6 is a schematic plan view illustrating the flow channel plate 12 according to a modification of the first embodiment. As illustrated in FIG. 6, in the recording head 2 according to the modification, bypass flow channels 57 that couple the first common liquid chamber 34 and the second common liquid chamber 36 are disposed separately from the individual flow channels. The bypass flow channel 57 has a larger flow-channel cross-sectional area than those of the individual flow channels to decrease flow channel resistance. Bubbles in the first common liquid chamber 34 can readily move through the bypass flow channel 57 to the second common liquid chamber 36. In this modification, the bypass flow channels 57 are disposed on both sides of the array of the individual flow channels. The recording head 2 may include at least one bypass flow channel 57. In this modification, the second outlet 32 is provided in the second common liquid chamber 36. More specifically, the second outlet 32 is closer to the other end portion (lower side in FIG. 6) than the first outlet 31 that is provided at a central portion of the second common liquid chamber 36 in the Y direction.

In this modification, an ink that is supplied from the second inlet 25 to the first common liquid chamber 34 in the second mode flows into the second common liquid chamber 36 via the bypass flow channels 57 and is fed from the second outlet 32 toward the second circulation flow channel 7, passes through the filter 48, and is supplied again to the first common liquid chamber 34 through the second inlet 25. With the structure according to the modification, in the second mode, the ink circulation is performed in the first common liquid chamber 34 and the second common liquid chamber 36. Accordingly, when bubbles are produced in the first common liquid chamber 34 and also in the second common liquid chamber 36, the bubbles in the common liquid chambers 34 and 36 can be removed. Furthermore, the second inlet 25 and the second outlet 32 are disposed at one end of the first common liquid chamber 34 in the Y direction and at the other end of the second common liquid chamber 36 in the Y direction respectively, and thereby staying of ink in the common liquid chambers 34 and 36, especially staying of ink at the end portions in the Y direction can be reduced, and bubbles can be more readily discharged from the common liquid chambers 34 and 36.

Figure 7:
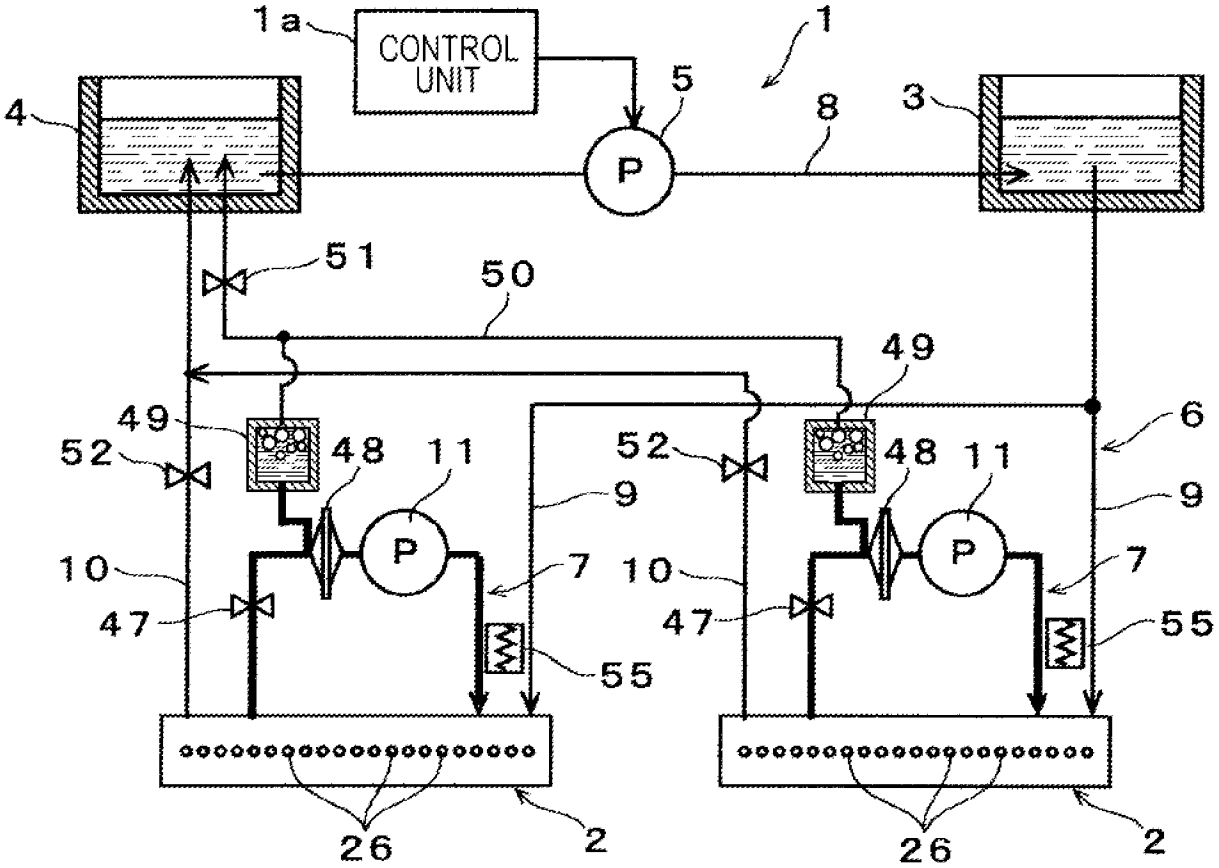
FIG. 7 is a schematic view of a circulation path of a liquid according to a second embodiment.

FIG. 7 is a schematic view illustrating a circulation path in the printer 1 according to a second embodiment. The structure according to the embodiment differs from that in the first embodiment in that the coupling flow channel 46 that couples the first circulation flow channel 6 and the second circulation flow channel 7 is not provided, a bubble buffer chamber 49 is disposed above the filter 48 in the vertical direction, and a heater 55 that heats the ink that flows through the second circulation flow channel 7 is provided along the second circulation flow channel 7. The bubble buffer chamber 49 has a predetermined volume, and into which bubbles caught by the filter 48 are drawn by buoyancy. The bubble buffer chamber 49 is coupled to the sub tank 4 via a discharge flow channel 50. An on-off valve 51 is disposed in the discharge flow channel 50, and the on-off valve 51 is opened or closed under the control by the control unit 1*a*. In this embodiment, an on-off valve 52 is disposed instead of the check valve 45 in the outlet channel 10 in the circulation flow channel 6. The heater 55 has a heating wire, for example, a nichrome wire. The control unit 1*a* controls connection and disconnection of electric power to the heating wire, and in the second mode, heats the ink flowing through the second circulation flow channel 7 to decrease the viscosity of the ink. The use of the heater 55 enables the ink viscosity adjustment. For example, the viscosity of an ink that has a relatively high viscosity such as photo-curable ink can be adjusted to a viscosity suitable for the discharge from the nozzles 26. Specifically, an ink that has a viscosity of 20 mPa·s or more and 200 mPa·s or less at 25° C. can be adjusted to have a viscosity suitable for the discharge from the nozzles 26. The heater 55 may be disposed at a position closer to the second inlet 25. With this structure, the decrease in ink temperature can be suppressed before actual ink discharge from the nozzles 26, and thus the viscosity adjustment accuracy can be increased. The heater 55 may heat the ink that flows through the second circulation flow channel 7 and the ink that flows through the first circulation flow channel 6, or a heater other than the heater 55 may be disposed for the first circulation flow channel 6 to heat the ink that flows through the first circulation flow channel 6.

In this embodiment, the ink circulation mode can be switched between the first mode for circulating ink through the first circulation flow channel 6 and the second mode for circulating ink through the second circulation flow channel 7. In the first mode according to the embodiment, the drive of the sub pump 11 is stopped and the on-off valve 47 and the on-off valve 51 are closed, and ink supplied from the main tank 3 by driving the main pump 5 with the on-off valve 52 being opened through the inlet channel 9 and the first inlet 23 to the first common liquid chamber 34 is fed to the second common liquid chamber 36 through the individual communication channels and discharged from the first outlet 31. With this structure, thickening of the ink and sedimentation of solid components such as pigments contained in the ink can be suppressed, and thus the high discharge performance of the nozzles 26 can be maintained. Furthermore, when the second mode is performed as maintenance processing for removing bubbles in the first common liquid chamber 34, the on-off valve 51 and the on-off valve 52 are closed, whereas the sub pump 11 is driven with the on-off valve 47 being opened to feed the ink in the first common liquid chamber 34 through the second outlet 32 to the second circulation flow channel 7, and the ink passes through the filter 48 and returns through the second inlet 25 to the first common liquid chamber 34. With this structure, bubbles in the first common liquid chamber 34 are caught by the filter 48 and thereby bubbles trapped in the first common liquid chamber 34 can be removed. Bubbles caught by the filter 48 are drawn into the bubble buffer chamber 49 by buoyancy and stored in the bubble buffer chamber 49. Bubbles in the bubble buffer chamber 49 is discharged toward the sub tank 4, for example, by regularly performing bubble discharge processing. The sub tank 4 is open to the atmosphere and bubbles are released from the sub tank 4 to the outside air. In the bubble discharge processing, the drive of the sub pump 11 is stopped and the on-off valve 52 is closed whereas the main pump 5 is driven with the on-off valve 47 and the on-off valve 51 being opened to discharge bubbles from the bubble buffer chamber 49 through the discharge flow channel 50 to the sub tank 4. The other structures are similar to those in the first embodiment. In this embodiment, the first mode and the second mode may be simultaneously performed.

Figure 8:
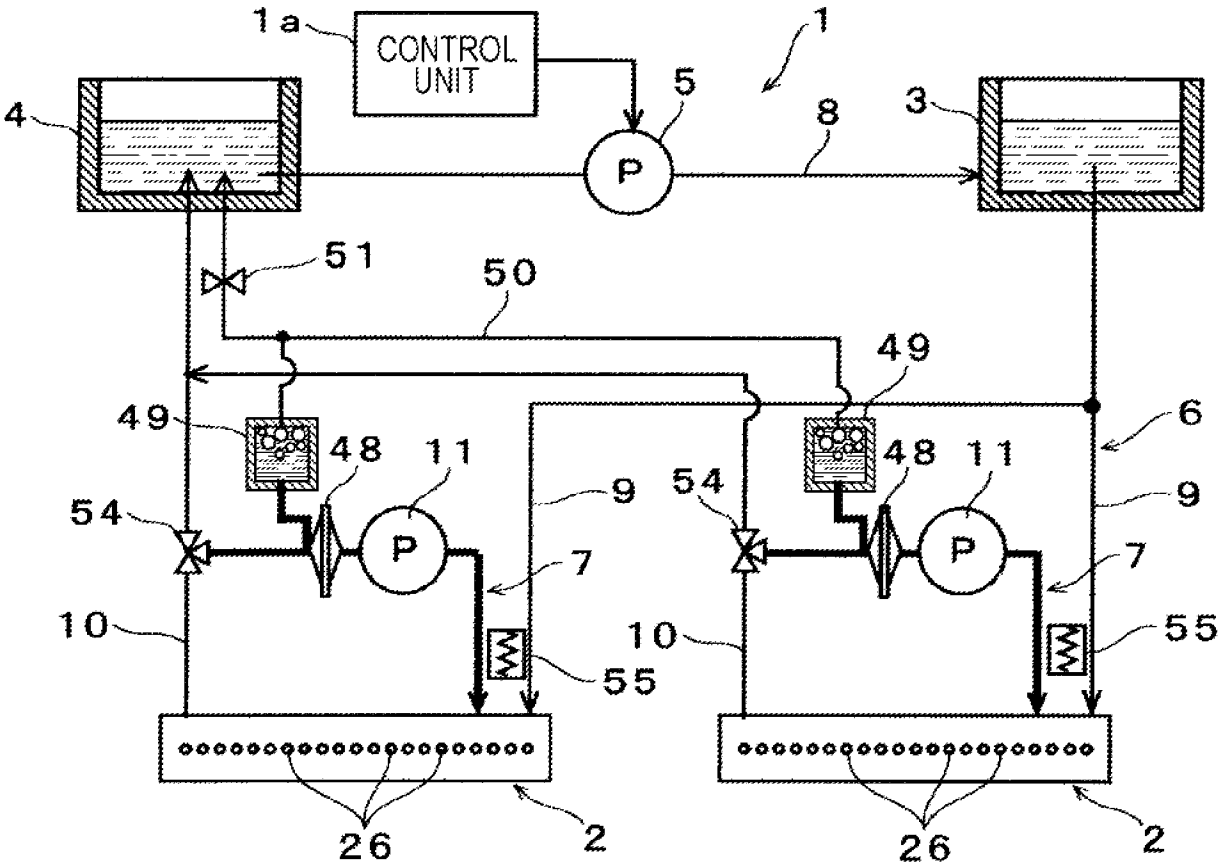
FIG. 8 is a schematic view of a circulation path of a liquid according to a third embodiment.
Figure 9:
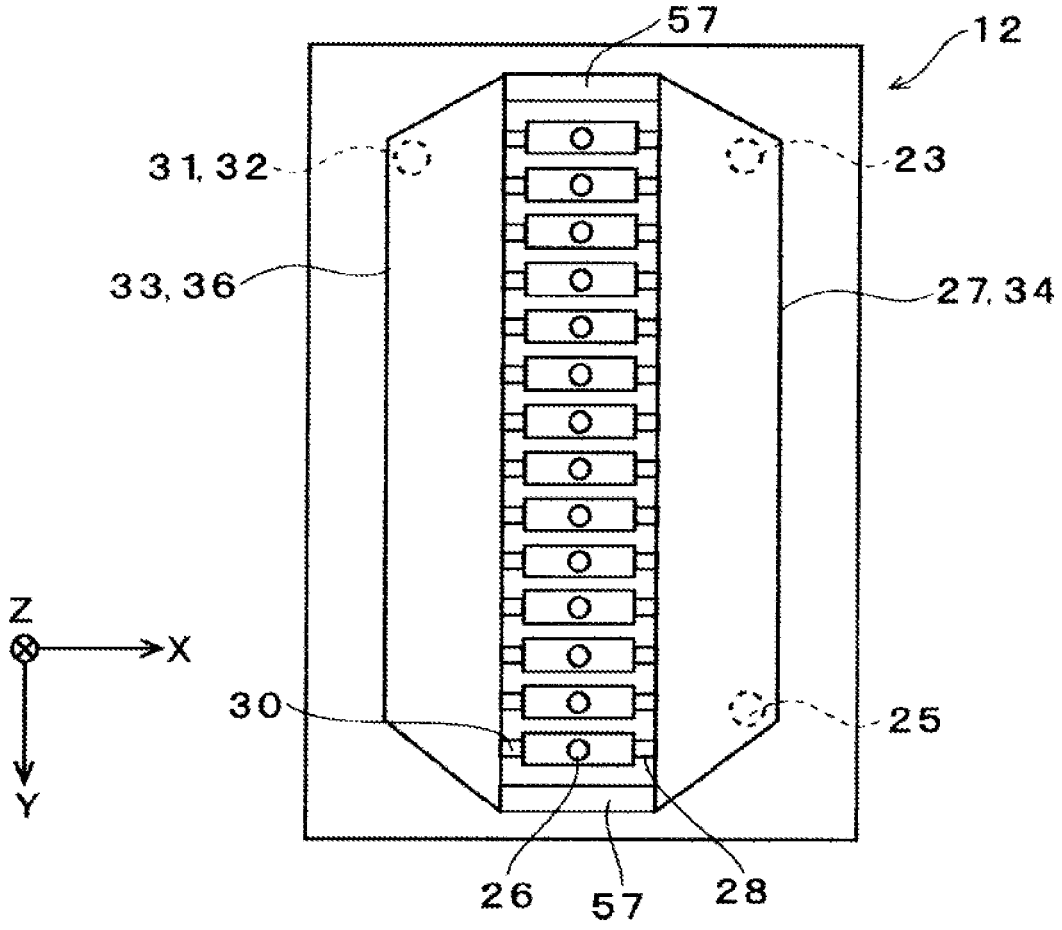
FIG. 9 is a schematic plan view illustrating a flow channel plate according to the third embodiment.

FIG. 8 is a schematic view illustrating a circulation path in the printer 1 according to a third embodiment. FIG. 9 is a schematic plan view illustrating the flow channel plate 12 according to the third embodiment. As illustrated in FIG. 9, in the recording head 2 according to the embodiment, similarly to the modification of the first embodiment, the bypass flow channels 57 that couple the first common liquid chamber 34 and the second common liquid chamber 36 are disposed separately from the individual flow channels. Furthermore, the first inlet 23 and the first outlet 31 are closer to one end portion (upper side in FIG. 9) than central portions of the first common liquid chamber 34 and the second common liquid chamber 36 in the Y direction, and the second inlet 25 is closer to the other end portion (lower side in FIG. 9) than the central portion of the first common liquid chamber 34 in the Y direction. The first outlet 31 is disposed across the individual flow channel from the first inlet 23, and in the Y direction, the distance between the first inlet 23 and the first outlet 31 is shorter than the distance between the first inlet 23 and the second inlet 25. Accordingly, in the first mode, the ink supply pressure to each nozzle 26 can be further evenly applied.

In this embodiment, an end of the second circulation flow channel 7 on the upstream side, that is, on the outlet side of the second common liquid chamber 36, is coupled through a switching valve 54 to the outlet channel 10 in the first circulation flow channel 6. In the first mode, the switching valve 54 is switched to couple the outlet channel 10 to the flow channel toward the sub tank 4 to circulate ink through the first circulation flow channel 6. On the other hand, in the second mode, the switching valve 54 is switched to couple the outlet channel 10 to the flow channel toward the second inlet 25 in the first common liquid chamber 34 through the filter 48, that is, to the second circulation flow channel 7 to circulate ink through the second circulation flow channel 7. Accordingly, in this embodiment, the first outlet 31 is used both in the first circulation flow channel 6 in the first mode and in the second circulation flow channel 7 in the second mode. The first outlet 31 thus functions as the second outlet 32 in the second mode. The other structures are similar to those in the second embodiment. In this embodiment, the first mode and the second mode are not simultaneously performed.

Figure 10:
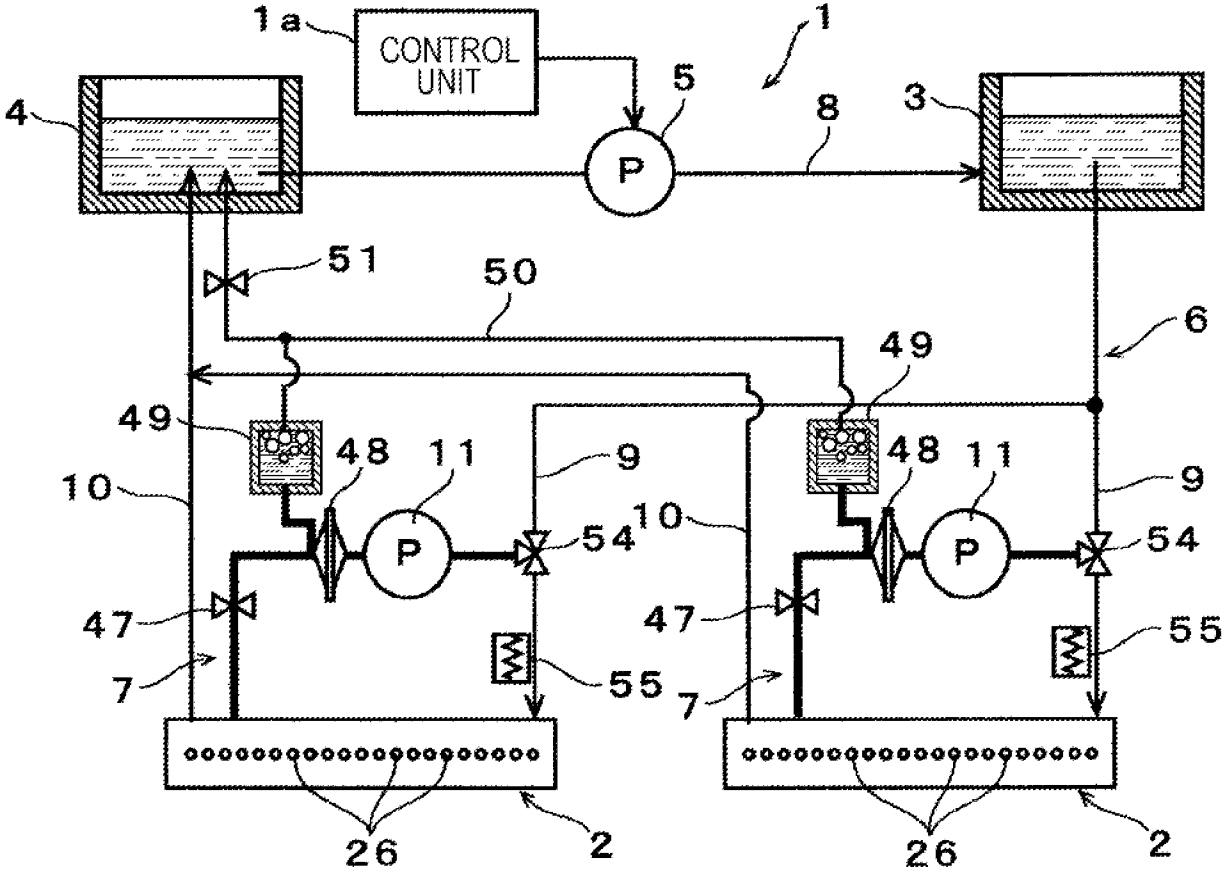
FIG. 10 is a schematic view of a circulation path according to a modification of the third embodiment.
Figure 11:
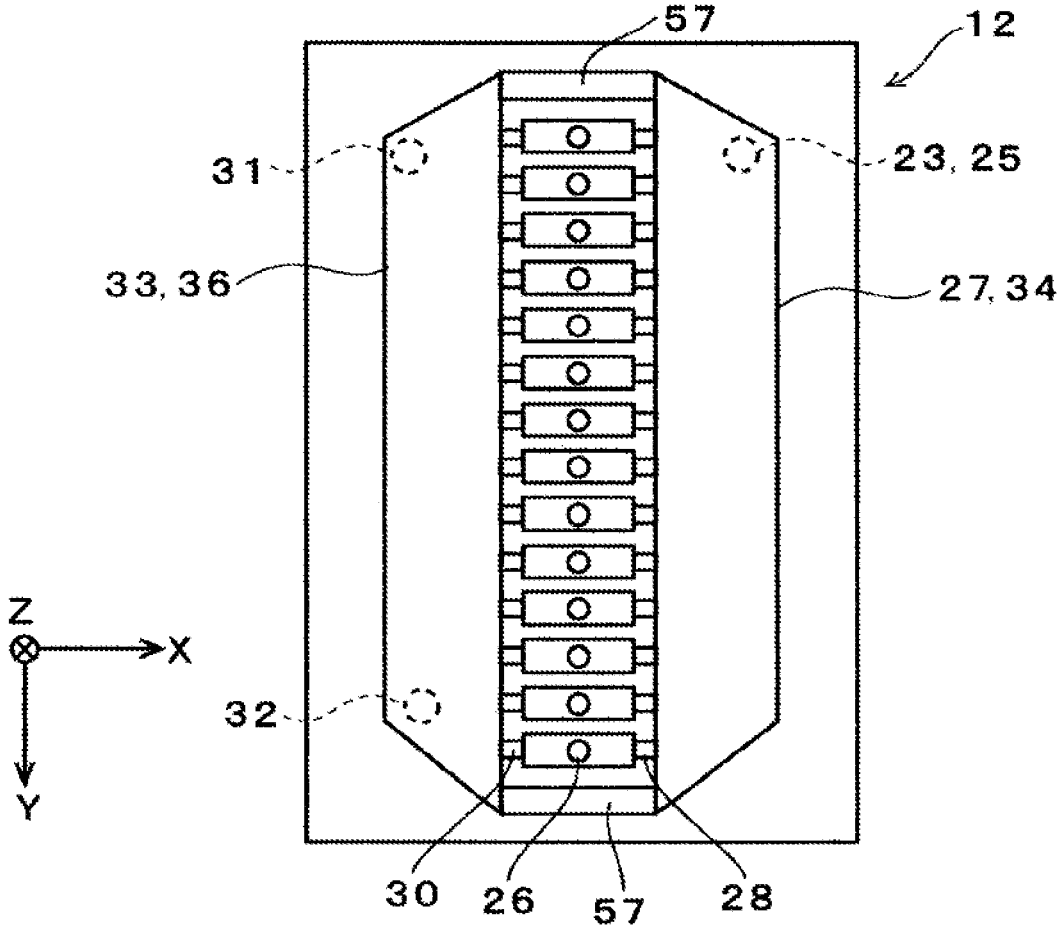
FIG. 11 is a schematic plan view illustrating a flow channel plate according to a modification of the third embodiment.

FIG. 10 is a schematic view illustrating a circulation path in the printer 1 according to a modification of the third embodiment. FIG. 11 is a schematic plan view illustrating the flow channel plate 12 according to the modification of the third embodiment. In this modification, the first outlet 31 and the second outlet 32 are provided in the second common liquid chamber 36, and only the first inlet 23 is provided in the first common liquid chamber 34. The first inlet 23 is closer to one end portion (upper side in FIG. 11) than the central portion of the first common liquid chamber 34 in the Y direction, and the first outlet 31 is closer to the one end portion than the central portion of the second common liquid chamber 36 in the Y direction. The second outlet 32 is closer to the other end portion (lower side in FIG. 11) than the central portion of the second common liquid chamber 36 in the Y direction. Accordingly, in the Y direction, the distance between the first inlet 23 and the first outlet 31 is shorter than the distance between the first inlet 23 and the second outlet 32.

In this modification, an end of the second circulation flow channel 7 on the downstream side of the filter 48, that is, on the inlet side of the first common liquid chamber 34, is coupled through the switching valve 54 to the inlet channel 9 in the first circulation flow channel 6. In the first mode, the switching valve 54 is switched to couple the main tank 3 with the first inlet 23 through the inlet channel 9 to circulate ink through the first circulation flow channel 6. On the other hand, in the second mode, the switching valve 54 is switched to couple the filter 48 and the sub pump 11 with the first inlet 23 through the second circulation flow channel 7 to circulate ink through the second circulation flow channel 7. Accordingly, in this modification, the first inlet 23 is used both in the first circulation flow channel 6 in the first mode and in the second circulation flow channel 7 in the second mode. The first inlet 23 thus functions as the second inlet 25 in the second mode. The other structures are similar to those in the third embodiment.

Figure 12:
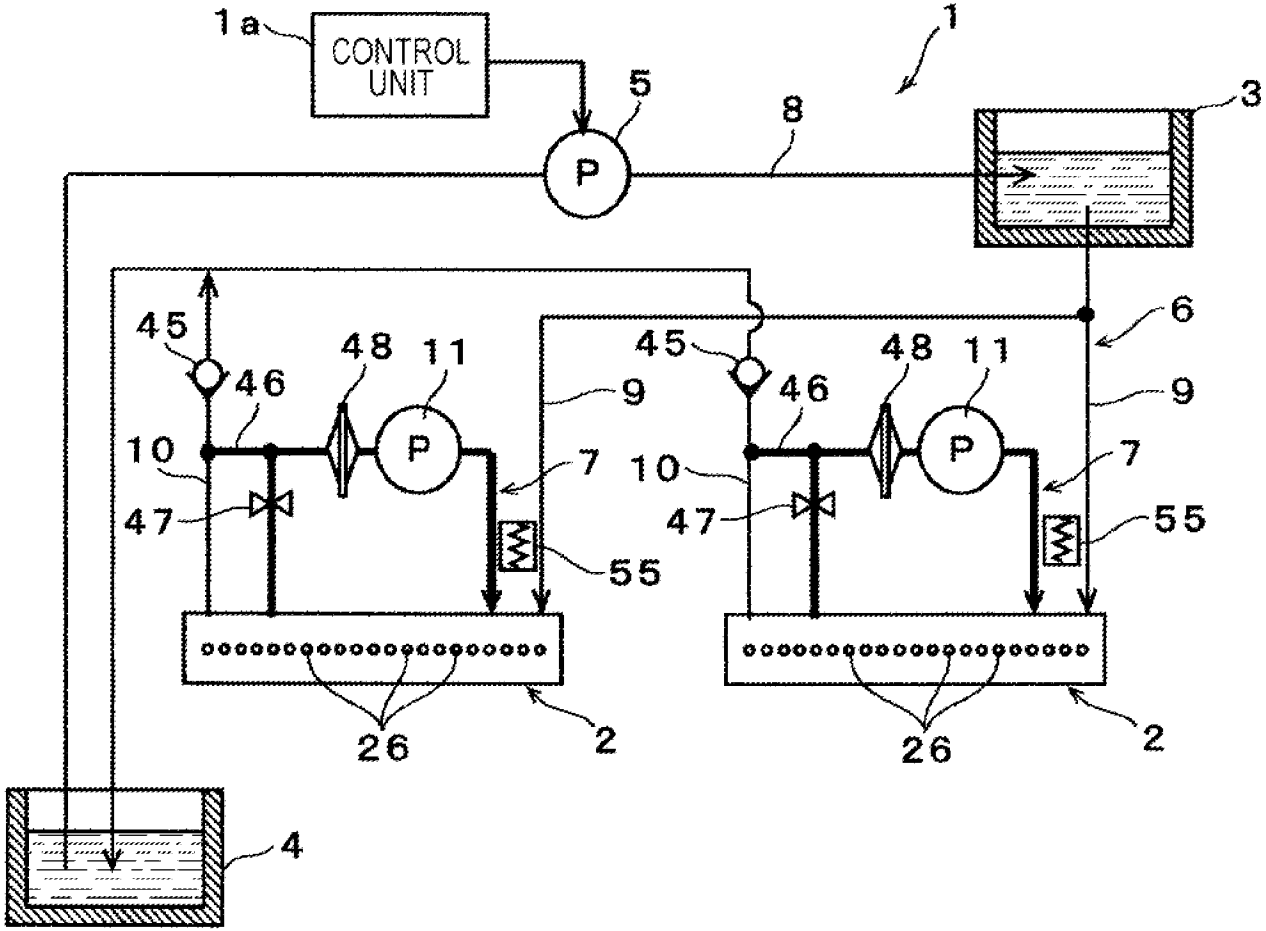
FIG. 12 is a schematic view of a circulation path of a liquid according to a fourth embodiment.

FIG. 12 is a schematic view illustrating a circulation path in the printer 1 according to a fourth embodiment. This embodiment differs from the above-described embodiments in that the main tank 3 is disposed above the nozzles 26 of the recording heads 2 in the vertical direction, whereas the sub tank 4 is disposed below the nozzles 26 of the recording heads 2 in the vertical direction. In this structure, in the first mode, ink is supplied by using a pressure difference caused by a water head difference among the main tank 3, the nozzles 26, and the sub tank 4. The ink can be returned from the sub tank 4 to the main tank 3 through the return flow channel 8 by driving the main pump 5. The other structures are similar to those in the above-described embodiments. In this embodiment, the ink circulation mode can be switched between the first mode in which ink is circulated through the first circulation flow channel 6 and the second mode in which ink is circulated through the second circulation flow channel 7. With this structure, in the first mode, liquid discharge operations such as printing operations can be performed while ink thickening and sedimentation of ink components are suppressed, and when bubbles are trapped in the common liquid chambers, the first mode can be switched to the second mode to remove the bubbles, and thus the bubble discharge performance can be increased.

Some embodiments of the present disclosure may be applied to a liquid discharge head in which liquid circulates through a liquid storage member and the liquid discharge head, and to a liquid discharge apparatus that includes the liquid discharge head. For example, some embodiments of the disclosure may be applicable to color material discharge heads to be used to manufacture color filters for liquid crystal displays or the like, electrode material discharge heads to be used to form electrodes for organic electro luminescence (EL) displays, field emission displays (FEDs), or the like, or liquid discharge heads having bioorganic substance ejecting heads to be used to manufacture biochips (biochemical elements), or may be applicable to liquid discharge apparatuses having any of these heads.

What is claimed is:

1. A liquid discharge head comprising:

an individual flow channel having a nozzle and a pressure chamber communicating with the nozzle;

a common liquid chamber having an inlet configured to receive a liquid and an outlet configured to discharge the liquid, the common liquid chamber coupled to a plurality of individual flow channels, each of which is the individual flow channel having the nozzle and the pressure chamber communicating with the nozzle, to supply the liquid to the individual flow channel, and the liquid is discharged from the individual flow channel; and a pressure generating element configured to cause fluctuations in pressure to the liquid in the pressure chamber, wherein the liquid discharge head is configured to switch between a first mode in which the liquid supplied into the common liquid chamber is discharged through the individual flow channel from the outlet and a second mode in which the liquid supplied into the common liquid chamber is discharged from the outlet without passing through the individual flow channel.

2. The liquid discharge head according to claim 1, wherein the inlet in the common liquid chamber includes a first inlet configured to receive the liquid in the first mode; and a second inlet configured to receive the liquid in the second mode.

3. The liquid discharge head according to claim 2, wherein the second inlet is disposed at a position farther than the first inlet with respect to a central portion of the common liquid chamber in a first direction in which the individual flow channels are aligned in parallel.

4. The liquid discharge head according to claim 2, wherein, the outlet includes a first outlet from which the liquid is discharged in the first mode, the first outlet being disposed across the individual flow channel from the first inlet, and in the first direction in which the individual flow channels are aligned in parallel, a distance between the first inlet and the first outlet is shorter than a distance between the first inlet and the second inlet.

5. The layout according to claim 4, wherein the common liquid chamber includes a first common liquid chamber having the first inlet and a second common liquid chamber having the first outlet, the second common liquid chamber being disposed across the individual flow channel from the first common liquid chamber.

6. The liquid discharge head according to claim 1, further comprising:

a first circulation flow channel configured to supply the liquid discharged from the common liquid chamber to the common liquid chamber in the first mode; and a second circulation flow channel configured to supply the liquid discharged from the common liquid chamber to the common liquid chamber in the second mode.

7. The liquid discharge head according to claim 6, further comprising:

a heater configured to heat the liquid flowing through the second circulation flow channel.

8. The liquid discharge head according to claim 7, wherein viscosity of the liquid at 25° C. is 20 mPa·s or more and 200 mPs·s or less.

9. A liquid discharge apparatus comprising:

the liquid discharge head according to claim 6;

a first storage member configured to store the liquid to which a pressure higher than a pressure applied to the liquid in the nozzle is applied, the first storage member being disposed in the first circulation flow channel;

a second storage member configured to store the liquid to which a pressure lower than a pressure applied to the liquid in the nozzles is applied, the second storage member being disposed in the first circulation flow channel; and a filter configured to filter the liquid flowing through the second circulation flow channel.

10. The liquid discharge apparatus according to claim 9, further comprising:

a coupling flow channel configured to pass a bubble caught by the filter toward the first circulation flow channel.

11. The liquid discharge apparatus according to claim 10, further comprising:

a unidirectional valve disposed between a point of coupling with the coupling flow channel and the second storage member in the first circulation flow channel, the unidirectional valve being configured to allow the liquid to flow from the point of coupling toward the second storage member and prevent the liquid from flowing from the second storage member toward the point of coupling.

12. The liquid discharge apparatus according to claim 9, further comprising:

a pump configured to feed the liquid through the second circulation flow channel, wherein the filler is disposed between a discharge position of the liquid in the common liquid chamber and the pump in the second circulation flow channel.

13. A method of controlling the liquid discharge apparatus according to claim 9, the method comprising:

switching between the first mode in which the liquid supplied into the common liquid chamber is discharged through the individual flow channel from the outlet and the second mode in which the liquid supplied into the common liquid chamber is discharged from the outlet without passing through the individual flow channel.

14. A method of controlling the liquid discharge head according to claim 1, the method comprising:

switching between the first mode in which the liquid supplied into the common liquid chamber is discharged through the individual flow channel from the outlet and the second mode in which the liquid supplied into the common liquid chamber is discharged from the outlet without passing through the individual flow channel.

* * * * *